US009005867B2

(12) United States Patent
Mang et al.

(10) Patent No.: US 9,005,867 B2
(45) Date of Patent: Apr. 14, 2015

(54) POROUS TONER AND PROCESS FOR MAKING THE SAME

(71) Applicant: Xerox Corporation, Norwalk, CT (US)

(72) Inventors: Mark E. Mang, Rochester, NY (US); Grazyna E. Kmiecik-Lawrynowicz, Fairport, NY (US); Mark A. Arnould, Rochester, NY (US); Dieu Nguyen, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/961,837

(22) Filed: Aug. 7, 2013

(65) Prior Publication Data

US 2015/0044606 A1 Feb. 12, 2015

(51) Int. Cl.
*G03G 9/08* (2006.01)
*G03G 9/087* (2006.01)

(52) U.S. Cl.
CPC ..... *G03G 9/08728* (2013.01); *G03G 9/0802* (2013.01); *G03G 9/0804* (2013.01)

(58) Field of Classification Search
CPC G03G 9/0804; G03G 9/0825; G03G 9/09392
USPC ..... 430/137.14, 110.1, 110.2
See application file for complete search history.

(56) References Cited

U.S. PATENT DOCUMENTS

| | | | | |
|---|---|---|---|---|
| 3,590,000 | A | 6/1971 | Palermiti | |
| 3,655,374 | A | 4/1972 | Palermiti | |
| 3,720,617 | A | 3/1973 | Chatterji | |
| 3,983,045 | A | 9/1976 | Jugle | |
| 4,298,672 | A | 11/1981 | Lu | |
| 4,338,390 | A | 7/1982 | Lu | |
| 4,379,825 | A | 4/1983 | Mitushashi | |
| 5,916,725 | A | 6/1999 | Patel | |
| 6,004,714 | A | 12/1999 | Ciccarelli | |
| 6,120,967 | A | 9/2000 | Hopper | |
| 6,190,815 | B1 | 2/2001 | Ciccarelli | |
| 7,867,679 | B2 * | 1/2011 | Nair et al. | 430/109.1 |
| 7,888,410 | B2 * | 2/2011 | Nair et al. | 523/339 |
| 2008/0268367 | A1 * | 10/2008 | Nair et al. | 430/137.1 |

* cited by examiner

*Primary Examiner* — Mark A Chapman
(74) *Attorney, Agent, or Firm* — Pillsbury Winthrop Shaw Pittman LLP

(57) ABSTRACT

A process includes forming a filter cake from a slurry of emulsion aggregation toner particles and washing the filter cake with an alcohol to create porous toner particles.

15 Claims, 4 Drawing Sheets

POROUS TONER AND PROCESS FOR MAKING THE SAME

FIELD

Embodiments disclosed herein relate to processes for preparing toner particles. More particularly, embodiments disclosed herein relate to processes for preparing porous toner particles.

BACKGROUND

A continual challenge in toner applications is maintaining a balance of print cost per page while maintaining print quality. Reduction of the toner particle size and adjustment of pigment loading is one approach to achieve this balance. However, the size of toner particles may only be reduced by so much while preserving proper function. Another way to accomplish this balance is to reduce raw material usage, which may be achieved, in part, through the use of porous toner particles.

Porous toner particles have been previously accessed in conventional milled toner particle systems by, for example, incorporating expendable water-soluble salt particles in a bulk composite composition prior to milling. In such a system, the additives are designed to be selectively solubilized after the product is milled to size. Such processes add manufacturing complexity because the additives generally require sufficient mixing operations to ensure even distribution of the additive throughout the resin matrix. Moreover, introducing these exogenous additives actually adds to raw material usage rather than reducing it.

Other processes to access porous toner particles have relied on complex multiple emulsion and suspension processes employing evaporative limited coalescence (ELC). Such processes are both material (solvent) and process time intensive. Moreover, such processes are generally complex requiring a careful balance of the miscibility of components between organic solvent(s) and water.

SUMMARY

In some aspects, embodiments disclosed herein provide processes comprising forming a filter cake from a slurry of emulsion aggregation toner particles and washing the filter cake with an alcohol thereby creating porous toner particles.

In some aspects, embodiments disclosed herein provide processes comprising providing porous toner particles by forming a filter cake from a slurry of emulsion aggregation toner particles, washing the filter cake with methanol thereby creating the porous toner particles, and drying the porous toner particles.

In some aspects, embodiments disclosed herein provide porous toner particles comprising a styrene-acrylate copolymer a wax; and a colorant, wherein a porosity of the porous toner particle is in a range from about 1% to about 50%.

BRIEF DESCRIPTION OF DRAWINGS

Various embodiments of the present disclosure will be described herein below with reference to the figures wherein.

DETAILED DESCRIPTION

Figure 1:
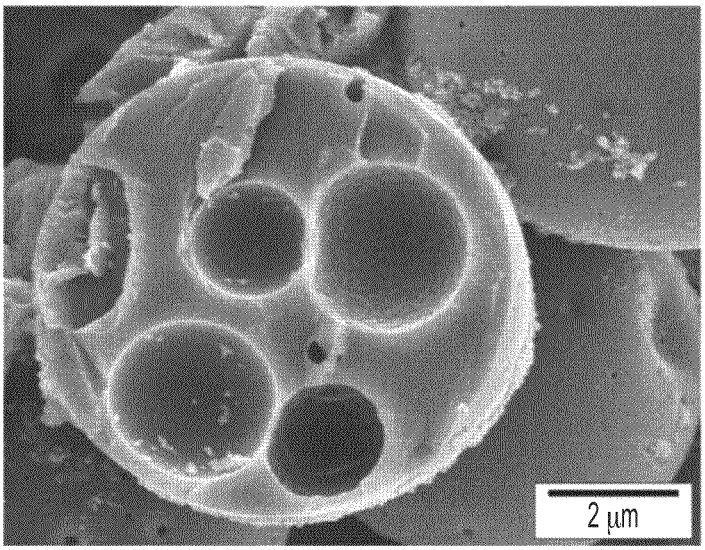
FIG. 1 PRIOR ART
FIG. 1 shows a scanning electron micrograph (SEM) image of a porous toner particle prepared via a known evaporative limited coalescence process.
Figure 2:
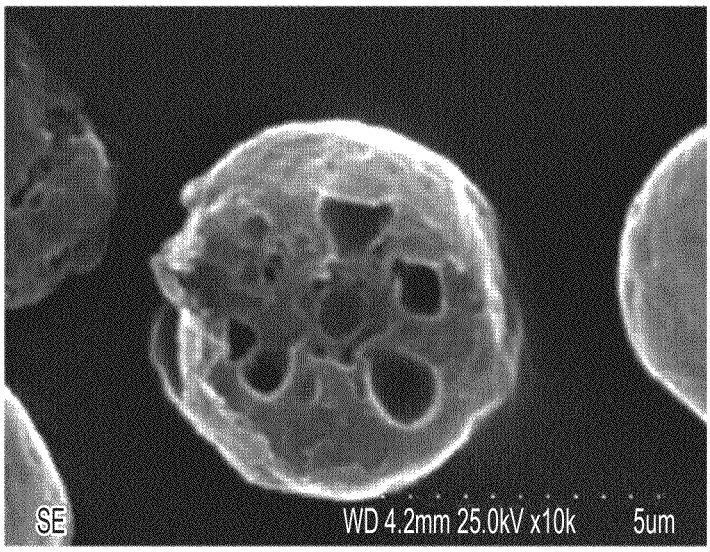
FIG. 2 PRIOR ART
FIG. 2 shows another SEM image of a porous toner particle prepared via a known evaporative limited coalescence process.
Figure 3:
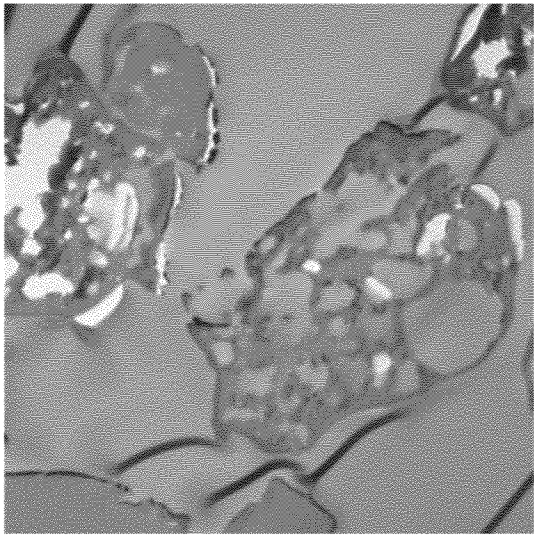
FIG. 3 shows a transmission electron micrograph (TEM) image of a porous toner particle prepared in accordance with embodiments disclosed herein.
Figure 4:
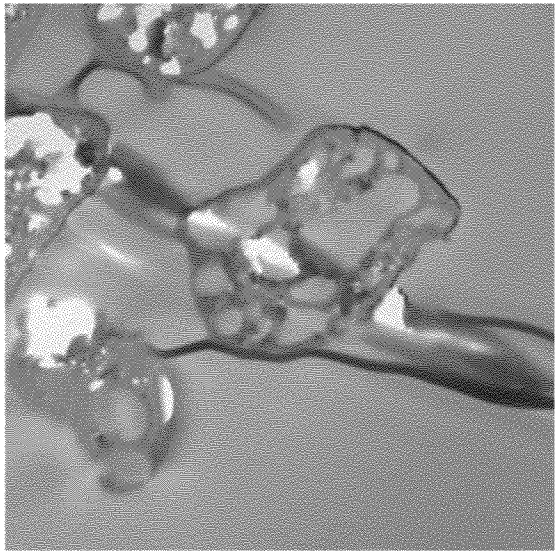
FIG. 4 shows another TEM image of a porous toner particle prepared in accordance with embodiments disclosed herein.

Embodiments disclosed herein provide processes for the preparation of porous toner particles directly from conventional emulsion aggregation (EA) particles via a late stage organic polar protic solvent wash, such as with an alcohol, exemplified by methanol. Advantageously, this solvent washing step may be performed in-line during normal toner particle washing and isolation operations. Such a solvent wash may be performed before, after or between any normal washing process steps. Thus, after toner particle synthesis is complete, the mother liquor may be removed and the resulting filter cake of toner particles subjected to various washing steps as part of an overall washing process, while the porosity-generating organic solvent wash disclosed herein may be inserted at any stage. A common washing process may include, for example, (1) removal of the mother liquor, re-slurry of toner particles in deionized water, (2) water removal via a filter press, (3) re-slurry of toner particles in dilute $HNO_3$ solution, (4) water removal again via filter press, (5) re-slurry of toner particles in deionized water as a final rinse, and (6) a final water removal via filter press. The final washed filter cake of toner particles will generally be carried through to a drying process. To achieve the porous toner particles disclosed herein, one need only insert a single alcohol solvent washing step anywhere along the line of the typical washing process. Such process simplicity to provide toner porosity functionality provides a substantial advantage over processes utilizing complex evaporative limited coalescence (ELC) and can provide substantial cycle time, material, and cost savings.

Processes disclosed herein preserve well-established protocols to access toner particles of narrow size and shape distribution through emulsion aggregation/coalescence, avoiding the need to employ older milling techniques incorporating exogenous expendable additives. Such expendable additives may ameliorate the cost benefits of employing porous toner particles. Other advantages of porous toner particles disclosed herein will be evident to those skilled in the art. For example, toner particles with about 50% porosity may only require half as much mass to accomplish similar imaging results. Therefore, the use of porous toner particles disclosed herein may lower the cost per page while decreasing the pile height. This, in turn, may provide a thinner image that reduces curl, reduces image relief, saves fusing energy, and may provide a look and feel similar to offset printing. Moreover, the porous toner particles disclosed herein may also narrow the cost gap between color and mono toner prints.

In accordance with embodiments disclosed herein, it was unexpectedly discovered that toner particles washed in an alcohol, such as methanol, provided toner particles having pores and hollow areas in the interior. Without being bound by theory, it has been postulated that such alcohol solvents may selectively remove a portion of the polymer resin from the interior of the toner particle imparting a porous internal structure to the toner particle. Matrix-assisted laser desorption/ionization (MALDI) analysis suggests the mechanism for pore formation may involve an affinity of the alcohol solvent for polar groups found within the toner polymer resin such as sulfate (derived from initiator) and/or dodecane thiol (derived from the chain transfer agent). Polar end groups and the amount (relative to chain length) of n-butyl acrylate, or other polar co-monomer component, appear to make certain polymer chains readily soluble in the alcohol solvent allowing their selective removal from the toner particle. Thus, the polar protic alcohol solvents appear to have an affinity for the functionalized polar polymer groups allowing their preferential removal from the toner particle. The structural characteristics of the holes in the toner particle may result from the more polar molecules having a tendency to align within the toner matrix. Because the polymer portion comprising polar groups are a relatively small portion of the overall toner particle, the polymer chains lacking polar groups (or other non-polar co-monomer) content are preserved intact.

The porous toner particles accessed by processes disclosed herein may be used in conjunction with any combination of colorants, fixing resins, and charge control agents in dry form or in a liquid vehicle for development onto a receptor, and for developers with dry carrier or a liquid vehicle. Such downstream processing of porous toner particles may have application to, without limitation, xerography, ionography, and magnetography.

In some embodiments, there are provided processes comprising forming a filter cake of emulsion aggregation toner particles from a slurry and washing the filter cake with an alcohol thereby creating a plurality of porous toner particles. In some such embodiments, the alcohol may be methanol, although other polar protic solvents may be capable of providing substantially the same result.

As used herein, "slurry" refers to a suspension of toner particles in a bulk solvent, which will typically be water when employing a conventional wash. In toner particle preparation, the mother liquor from the aggregation/coalescence process may make up the initial bulk solvent of a slurry.

As used herein, "emulsion aggregation toner particles," generally refers to toner particles assembled from a polymer resin latex, i.e. a dispersion of a polymer resin, in the presence of any number of additional additives including, for example, waxes, colorants, coalescing agents/aids, and the like. Emulsion aggregation encompasses coalescence processes as well. Emulsion aggregation processes are well known in the art. Emulsion aggregation toner particles further encompasses so-called core-shell toner particles in which a separate shell latex is disposed about the surface of a core toner particle during coalescence.

As used herein, "washing," encompasses any type of treatment of toner particles with a fluid intended to remove or add certain materials to the toner particles. In accordance with embodiments disclosed herein, washing also encompasses dissolution of portions of toner particles to provide porosity. Washing may be optionally performed dynamically. Washing may optionally involve re-suspension of toner particles in a slurry.

In embodiments, washing a filter cake of toner particles with methanol, in particular, may be performed by suspension of toner particles in methanol, followed by filtration in a filter press, such as a LAROX® filter press (Lappeenranta, Finland). In embodiments, the filter cake may remain in place in the press and methanol may be continuously cycled through the filter cake. For the purpose of minimizing solvent usage, the methanol may be a fixed amount that is continuously recycled through the filter cake. In other embodiments, methanol may be added for the purpose of re-suspending the toner particles and the toner particles may then be re-filtered through a filter press after stirring/aging in methanol for a period of about 5 minutes to about 240 minutes. In general, washing with methanol to form porous toner particles may comprise exposure to methanol for a period of time in a range from about 5 minutes to about 240 minutes, regardless of the mode by which the toner particles are exposed to the solvent. Without being bound by theory, it has been postulated that the degree of porosity may be controlled by contact time with the solvent, in this case methanol.

In embodiments, the methanol employed in the wash may be provided at ambient temperature, i.e. about 25° C. In other embodiments, the methanol may be cooled or heated. In embodiments, cooled methanol may include any temperature down to near the freezing point of methanol (or other alcohol or polar protic solvent). Likewise methanol (or other alcohol or polar protic solvent) may be heated to any temperature up to near its boiling point.

In embodiments, alcohols that may be employed in processes disclosed herein include methanol, ethanol, isopropyl alcohol, n-butanol, and the like. In some embodiments, combinations of alcohols or other polar protic solvents may be employed. In embodiments, polar aprotic solvents may also be used, such as DMF, DMSO, THF, and the like. In embodiments, mixtures of polar protic and polar aprotic solvents may be employed. The exact choice of solvents and temperatures may depend on, inter alia, the exact composition of the toner particle, including any compositional differences that may exist between a core and shell composition in such configurations. By way of example, in a prototypical styrene-acrylate toner particle system, ambient temperature methanol washing in continuous mode may confer useful levels of porosity to the toner particles. As indicated by the MALDI results described above, the portion of toner resin material dissolved from the toner particles comprises substantially the polar fractions of the polymer resin. Thus, the exact selection solvent systems may be selected based on matching solubilities in particular polar co-monomer/non-polar co-monomer mixtures to alter the degree of solubilization of polar components of the toner particles, and hence tune porosity to a desirable level.

In embodiments, the emulsion aggregation toner particles may comprise a copolymer resin comprising a monomer unit selected from the group consisting of styrenes, acrylates, methacrylates, butadienes, isoprenes, acrylic acids, methacrylic acids, acrylonitriles and combinations thereof. Any suitable resin employed in the manufacture of toner particles may be employed. The resin composition may comprise one or more resins, such as two or more resins. The total amount of resin in the resin composition can be from about 1% to 99%, such as from about 10% to about 95%, or from about 20% to 90% by weight of the resin composition. In embodiments, the emulsion aggregation toner particles comprise a copolymer having a polar monomer content in a range from about 1% to about 15% by weight of total monomer content in the copolymer. In embodiments, a porosity of the porous toner particles may be in a range from about 1% to about 50%, which porosity may be a function, in part, on the ratio of the polar co-monomer and non-polar co-monomer components. In embodiments, characterization of porosity may be readily assessed by standard methods known to those skilled in the art including, without limitation, scanning electron microscopy (SEM) imaging, transmission electron microscopy (TEM) imaging, measurement of particle density, surface area and pore volume via the Brunauer, Emmett and Teller (BET) method, and the like. In particular embodiments, the porous toner particles accessed by methods disclosed herein may have a reduction in density relative to untreated particles in a range from about 1% to 50%. In embodiments, the porous structure may reflect alignment of polar moieties with the resin matrix during aggregation/coalescence. That is, the alignment may determine where the pores will be imparting a level of control over how the pores are formed.

A resin employed as a toner particle as disclosed herein may be any latex resin utilized in forming Emulsion Aggregation (EA) toners. Such resins, in turn, may be made of any suitable monomer. Any monomer employed may be selected depending upon the particular polymer to be used. Two main types of EA methods for making toners are known. First is an EA process that forms acrylate based, e.g., styrene acrylate, toner particles. See, for example, U.S. Pat. No. 6,120,967, incorporated herein by reference in its entirety, as one example of such a process. A second is an EA process that forms polyester, e.g., sulfonated polyester. See, for example, U.S. Pat. No. 5,916,725, incorporated herein by reference in its entirety, as one example of such a process.

Illustrative examples of latex resins or polymers for toner particles include, but are not limited to, styrene acrylates, styrene methacrylates, butadienes, isoprene, acrylonitrile, acrylic acid, methacrylic acid, beta-carboxy ethyl arylate, polyesters, known polymers such as poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly (ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly (styrene-butyl acrylate-methacrylic acid), poly(styrene-butyl acrylate-acrylonitrile), poly(styrene-butyl acrylate-acrylonitrile-acrylic acid), and the like, and mixtures thereof. The resin or polymer can be a styrene/butyl acrylate/carboxylic acid terpolymer. At least one of the resin substantially free of crosslinking and the cross linked resin can comprise carboxylic acid in an amount of from about 0.05 to about 10 weight percent based upon the total weight of the resin substantially free of cross linking or cross linked resin.

The monomers used to access the selected polymer are not limited, and the monomers utilized may include any one or more of, for example, styrene, acrylates such as methacrylates, butylacrylates, β-carboxy ethyl acrylate (β-CEA), etc., butadiene, isoprene, acrylic acid, methacrylic acid, itaconic acid, acrylonitrile, benzenes such as divinylbenzene, etc., and the like. Known chain transfer agents, for example dodecanethiol or carbon tetrabromide, can be utilized to control the molecular weight properties of the polymer. Any suitable method for forming the latex polymer from the monomers may be used without limitation.

In some embodiments, the polymer resin employed in toner particles need not be limited to those prepared by emulsion polymerization of the aforementioned co-monomers. By way of example, in some embodiments, the toner particle resin may comprise a mixture of polyesters having sufficiently different polarities to impart selective removal of a portion of the more polar resin.

In embodiments, the emulsion aggregation toner particles have a shell-core configuration. In embodiments, pores are present in the shell and the core. In embodiments, a porosity percentage in the shell is less than a porosity percentage in the core. In some embodiments, a porosity percentage in the shell is more than a porosity percentage in the core. The ability to differentially tune the porosity in the shell and the core may be achieved by selection of appropriate latex starting materials. Thus, for example, where it may be desirable to have a more porous core structure, a resin with a greater percentage of polar co-monomer components may be employed in synthesizing the latex particles for use in preparation of the core. In particular embodiments, it may be beneficial to have a highly porous core, while maintaining a relatively non-porous outer shell structure. For example, such benefit may include having a relatively smooth shell surface onto which external toner additives, such as hydrophobized silica, titania, and the like may readily adhere to the surface without becoming included within the pores of the toner particle structure. Likewise, there may arise applications in which it may be desirable to have a more porous shell structure with a less porous core.

In some embodiments, processes disclosed herein comprise further washing steps with water, an acid, a base, or combinations thereof. In embodiments, the washing step of processes disclosed herein may comprise one or more dynamic washings. In embodiments, a wash may be selected to remove certain contaminants while allowing desirable toner additives to remain associated with the toner particles. In embodiments, the washing step may be carried out by re-suspending the toner particles in a slurry, while in other embodiments the washing step may be performed directly on the filter cake of toner particles without appreciable re-suspension to a slurry.

Washings may be carried out at a pH of from about 2.5 to about 12, and in embodiments at a pH of from about 3 to about 11. The washing may be at a temperature of from about 10° C. to about 45° C., in embodiments from about 20° C. to about 40° C. The washing may include filtering and re-slurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes. In embodiments, the particles may be washed about three times with water.

For example, in embodiments, toner particles may be washed in 40° C. deionized water, filtered, re-slurried with HCl acid addition, filtered, and re-slurried in fresh deionized water. The washes may continue until the solution conductivity of the filtrate is measured to be low (such as less than about 10 microsiemens per centimeter), which indicates that the ion content is significantly reduced and will not interfere with any surface metal treatments, such as treatment with zinc ion.

In embodiments, a wash step may be selected to add components to the toner particles, in particular, to provide additives that may adhere to the toner particle surface. In embodiments, a washing step may be employed with a metal ion solution. The washing with a metal ion solution may take place at a temperature of from about 30° C. to about 50° C. The metal ion solution, in embodiments including zinc, may be added dropwise to a slurry of toner particles in an amount of from about 1 to about 120 drops. The metal ion solution may be added dropwise to the slurry at a rate of from about 1 drops/min to about 120 drops/min, in embodiments from about 5 drops/min to about 100 drops/min, in embodiments from about 10 drops/min to about 60 drops/min, and mixed for a period of from about 0.5 hours to about 1.5 hours, in embodiments from about 0.75 hours to about 1.25 hours, in embodiments about 1 hour. During this time of mixing, the slurry may be slightly heated from about 20° C. to about 60° C., in other embodiments from about 30° C. to about 55° C., in further embodiments from about 35° C. to about 45° C. The zinc ions may attach to the toner surface in a controlled manner without aggregating the particles together.

In embodiments, the particles may then be subjected to an additional washing step including a metal ion in solution to enhance their charging characteristics. An increase in the amount of certain metal based charging agents, in embodiments zinc salicylate or other similar agent, on the surface of a toner particle may increase the charging of the toner particles. Thus, in accordance with the present disclosure, a washing step including such a metal ions may increase the charging of the toner particles.

In some embodiments, processes disclosed herein further comprise drying the porous toner particles. Thus, in embodiments, there are provided processes comprising providing a plurality of porous toner particles by filtering a slurry of emulsion aggregation toner particles to form a filter cake washing the filter cake with neat methanol thereby creating the porous toner particles, and washing and drying the porous toner particles.

In some embodiments, the process further comprises treating the washed and dried porous toner particles with an external toner additive. In some embodiments, the external toner additive comprises one selected from the group consisting of a charge control agent, a release agent, a modified silica, a modified titania, an organic spacer, and combinations thereof.

Suitable particulate toner additives may comprise any additive that is typically blended downstream in the preparation of a toner composition. Such toner additives are typically coated on the surface of the toner particles. In some embodiments the toner additive comprises one selected from the group consisting of an organic spacer particle, a silica, a titania, an alumina, a metal fatty acid salt, a rare earth metal oxide, a charge control agent and combinations thereof. In some embodiments, the toner additive may be one or more additives present in a surface additive package which is normally applied downstream to the toner particles after filtering and washing of the toner particles. Such additives are may be designed to adhere (although they may be free flowing) to the external surfaces of the toner particles, rather than being incorporated into the bulk of the toner particles. Such additives may serve to provide superior toner flow properties, high toner charge, charge stability, denser images, and/or lower apparatus contamination.

In some embodiments, the toner additive may comprise one or more silicas, including a silica that has been surface treated with hexamethyldisilazane (HMDS). In some embodiments, the silica may be a sol-gel silica. In some embodiments, the toner additive may comprise a polydimethylsiloxane (PDMS) silica.

In some embodiments, the toner additive employed in processes disclosed herein may include positive or negative charge control agents. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E88™, or zinc salts such as E-84 (Orient Chemical); combinations thereof, and the like.

In some embodiments, the toner additive employed in processes disclosed herein may comprise an organic spacer, such as polymethylmethacrylate (PMMA).

Other toner additives employed during filtering and washing may include, for example, metal salts, metal salts of fatty acids, colloidal silicas, metal oxides, strontium titanates, combinations thereof, and the like. Examples of such additives include, for example, those disclosed in U.S. Pat. Nos. 3,590,000, 3,720,617, 3,655,374, and 3,983,045, the disclosures of each of which are hereby incorporated by reference in their entirety. Other toner additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety.

In particular embodiments, the toner additive may be a fatty acid metal salt which may impart lubricity. Suitable fatty acid metal salts for this purpose may include, without limitation, stearate salts such as zinc stearate, magnesium stearate, or calcium stearate.

In embodiments, there are provided porous toner particles comprising a styrene-acrylate copolymer, a wax. In embodiments, porous toner particles may further include an optional colorant. The porosity of the porous toner particle may be in a range from about 1% to about 50%. In embodiments, porous toner particles disclosed herein may have a reduction in density relative to untreated particles in a range from about 1% to 50%. In embodiments, the porous toner particles disclosed herein may range in size from about 3 to about 7 microns. In embodiments, such porous toner particles may have a shell-core configuration. In such embodiments, the porous particles may have a porosity in the shell that is less than a porosity percentage in the core. In embodiments, the core may have a porosity of about 1% to about 50%. Such porous toner particles may be accessed in accordance with the methods disclosed herein. For example, a shell portion of a toner particle having lower porosity than the core may be accessed by decreasing the polar co-monomer fraction in the shell latex relative to the amount employed in the core latex.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

This example describes the preparation porous toner particles by methanol washing of EA toner particles.

Emulsion aggregation particles were washed as follows: A slurry containing the formed particles was placed in a Larox filter press and the liquid was removed. The resulting wet cake was weighed and added to a mixing vessel. The wet cake was re-slurried with a 6:1 ratio of 40° C. water and 0.3M nitric acid was added to the mixture. The acid was added based on the weight of the wet cake in a ratio of 0.0428. The mixture was re-slurried for about 40 minutes. The slurry was fed into the Larox and pressed. A second acid wash was performed as described above. The slurry was pressed in the Larox to remove most of the liquid and washed a third time using a 6:1 ratio of deionized water. About 100 g of the particles were added to a 500 mL plastic bottle. Enough room temperature methanol was added to completely cover the particles in the bottle (about 200 mL). The mixture was placed on a shaker table for about 20 minutes. The methanol was filtered off using a Buchner funnel in the lab. The resulting wet cake was re-slurried for about 40 minutes with 40 C deionized water and the water was removed using the Buchner funnel. The resulting washed toner particles were dried using a freeze dryer.

Examination of the particles with SEM and TEM showed a high level of porosity both internally and externally. Results from the MALDI (Matrix Assisted Laser Desorption Ionization) indicated that there may be an affinity of methanol to the polar groups found within the resin such as sulfate (in the initiator) and dodecanethiol (chain transfer agent). The polar end groups and the large amount of poly n-butylacrylate appear to make the chains readily soluble in methanol allowing easier removal from the particle. Due to the fact that these chains are a relatively small portion of the overall toner particle, the chains with high amounts of polystyrene content or non polar groups are preserved intact.

What is claimed is:

1. A process comprising:

forming a filter cake from a slurry of emulsion aggregation toner particles; and washing the filter cake with an alcohol methanol thereby creating porous toner particles.

2. The process of claim 1, wherein the emulsion aggregation toner particles comprise a copolymer formed from a monomer unit selected from the group consisting of styrenes, acrylates, methacrylates, butadienes, isoprenes, acrylic acids, methacrylic acids, acrylonitriles and combinations thereof.

3. The process of claim 1, wherein the emulsion aggregation toner particles are formed from a copolymer having a polar monomer content in a range from about 1 percent to about 15 percent by weight of total monomer content in the copolymer.

4. The process of claim 1, wherein a porosity of the porous toner particles is in a range from about a reduction in density relative to untreated particles in a range from about 1% to 50%.

5. The process of claim 1, wherein the emulsion aggregation toner particles have a shell-core configuration.

6. The process of claim 5, wherein pores are present in the shell and the core.

7. The process of claim 6, wherein a porosity percentage in the shell is less than a porosity percentage in the core.

8. The process of claim 6, wherein a porosity percentage in the shell is more than a porosity percentage in the core.

9. The process of claim 1, wherein the porous toner particles have a density in a range from about a reduction in density relative to untreated particles in a range from about 1% to 50%.

10. The process of claim 1, further comprising a washing step with water, an acid, or combinations thereof.

11. The process of claim 1, further comprising drying the porous toner particles.

12. A process comprising:

providing porous toner particles by:

forming a filter cake from a slurry of emulsion aggregation toner particles;

washing the filter cake with methanol thereby creating the porous toner particles; and drying the porous toner particles.

13. The process of claim 12, wherein a porosity of the porous toner particles is in a range from about a reduction in density relative to untreated particles in a range from about 1% to 50%.

14. The process of claim 12, wherein the process further comprises treating the dried porous toner particles with an external toner additive.

15. The process of claim 14, wherein the external toner additive comprises one selected from the group consisting of a charge control agent, a release agent, a modified silica, a modified titania, an organic spacer, and combinations thereof.

* * * * *